US008120266B2

(12) United States Patent
Huber

(10) Patent No.: US 8,120,266 B2
(45) Date of Patent: Feb. 21, 2012

(54) DRIVING CIRCUIT FOR DRIVING A LOAD

(75) Inventor: Manfred Huber, Grassbrunn (DE)

(73) Assignee: STMicroelectronics Design And Application GmbH, Grassbrunn (DE)

( * ) Notice: Subject to any disclaimer, the term of this patent is extended or adjusted under 35 U.S.C. 154(b) by 292 days.

(21) Appl. No.: 12/610,113

(22) Filed: Oct. 30, 2009

(65) Prior Publication Data

US 2011/0101878 A1 May 5, 2011

(51) Int. Cl.
*H05B 37/02* (2006.01)

(52) U.S. Cl. ..... 315/224; 315/225; 315/226; 315/299; 315/308; 315/360

(58) Field of Classification Search ..... 315/209 R, 315/224, 225, 226, 291, 299, 307, 308, 360
See application file for complete search history.

(56) References Cited

U.S. PATENT DOCUMENTS 5,883,483 A * 3/1999 Nagata et al. ..... 318/696
5,999,041 A * 12/1999 Nagata et al. ..... 327/538
7,119,495 B2 * 10/2006 Jang ..... 315/244
7,928,703 B2 * 4/2011 Tan et al. ..... 323/224

* cited by examiner

*Primary Examiner* — Thuy Vinh Tran
(74) *Attorney, Agent, or Firm* — Seed IP Law Group PLLC

(57) ABSTRACT

A driving circuit comprises a first and a second switching circuit coupled in parallel to a node which is adapted to be coupled to a load, a first and a second detecting circuit, and a synchronizing circuit having an input coupled to the first and second detecting circuits and having an output coupled to the first and second switching circuits. The first detecting circuit detects a current associated with the first switching circuit and the second detecting circuit detects a current associated with the second switching circuit. The synchronizing circuit operates the first and second switching circuits to switch synchronously to a conducting state, and operates the first and second switching circuits to switch synchronously to a non-conducting state in the event that one of the first and second detecting circuits detects a current equal to or higher than a threshold value.

20 Claims, 8 Drawing Sheets

DRIVING CIRCUIT FOR DRIVING A LOAD

BACKGROUND

1. Technical Field

This disclosure relates to a driving circuit having a switching circuit for driving a load, particularly for driving a load with high inrush current such as a bulb.

2. Description of the Related Art

One approach that has been used for a driving circuit having a switching circuit connected to a load is shown in FIG. 1. The driving circuit 1 according to FIG. 1 has a switching circuit 2 which is coupled to a load 3, which is in the present example a bulb or incandescent lamp. The switching circuit 2 may comprise one or more switching elements such as transistors and has a control input for switching the switching circuit 2 in a conducting or non-conducting state, and has a controlled path coupled to the load 3 at a first node and coupled to a reference potential GND (in the present example ground potential) at the other node. At the terminal opposite to the switching circuit 2, the bulb 3 is connected to a supply voltage V.

In order to operate the bulb 3, the switching circuit 2 is operated to switch into a conducting state, so that the bulb 3 is connected between the supply voltage V and the reference potential GND. FIG. 2 shows a signal diagram which depicts an example of an inrush current of a driving circuit of the principle as shown in FIG. 1 when driving a bulb (e.g. a bulb with nominal power of 5 W). As can be seen from the signal diagram according to FIG. 2, when switching the switching circuit 2 from non-conducting state to conducting state at time 0, the inrush current of the bulb 3 is, in this example, approximately 10 times higher than the average or stationary current. In the present example, the high inrush current results from heating up the glow filament of the bulb. Usually, such high inrush current is disadvantageous with respect to the switching circuit 2, since the switching circuit 2 must be capable to switch a high inrush current which is a multiple of the stationary current, which may result in high thermal stress, and big chip size as the switching circuit has to have a large size for switching high inrush currents and dissipating the power loss.

In order to avoid such critical inrush currents, another common prior approach is to limit the inrush current at a fixed value, for example limit the inrush current at a fixed value of 0.8 A in the example of FIG. 3. In this regard, FIG. 3 shows a signal diagram depicting another example of an inrush current of a driving circuit of the principle as shown in FIG. 1 with limitation of the inrush current at a fixed value (here 0.8 A) according to this common approach. However, this approach also has several disadvantages, such as high power dissipation on the integrated circuit with the switch (which results in high power dissipation on silicon), high thermal stress, big chip size, and thus increased manufacturing costs of the integrated circuit. Particularly, when limiting the inrush current at a fixed value, a considerable portion of the potential between the supply voltage V and the reference potential GND (which is a relative large voltage drop) must occur across the switching circuit 2 as a result of the rather low inrush current and the rather low voltage drop across the bulb 3 during the heating up period.

In FIG. 4, there is shown an exemplary driving circuit for driving a load with high inrush current, such as a bulb, according to another prior approach using a pulse width modulated control circuit for driving the load. The driving circuit according to FIG. 4 employs a so called "soft start function" or "over-current recovery mode". Like in the example of FIG. 1, the driving circuit 10 according to FIG. 4 comprises a switching circuit 12 which is coupled with a controlled path between a bulb 3 and a reference potential GND, the bulb 3 connected at its other end to supply voltage V. The switching circuit 12 has a control input for switching the switching circuit 12 into a conducting or non-conducting state, wherein in the present example the control input of the switching circuit 12 is coupled to a gate driver 13. The gate driver 13 is coupled to a signal line 17 for receiving an enable signal for activating the driving circuit 10 (signal "ON") or disabling the driving circuit 10 (signal "OFF"). The driving circuit 10 further comprises a detecting circuit 14 for detecting an over current in the controlled path of the switching circuit 12. Particularly, the detecting circuit 14 detects if the current in the controlled path of the switching circuit 12 between the bulb 3 and the reference potential GND equals or is higher than a particular threshold value. An output of the detecting circuit 14 is coupled to a latch 15, an output of which is coupled to the gate driver 13 and to a recovery timer 16. A reset input of the latch 15 is coupled to an output of the recovery timer 16.

The function of the driving circuit according to FIG. 4 will now be explained with reference to FIG. 5. FIG. 5 shows a signal diagram depicting an example of a limited inrush current of a driving circuit of the principle as shown in FIG. 4 when driving a bulb. The signal diagram of FIG. 5 also shows in comparison to the limited inrush current an unlimited inrush current as shown and discussed above with reference to FIG. 2. In the signal diagram of FIG. 5, when switching the switching circuit 12 to a conducting state, the load current of the bulb 3 increases until the current reaches a threshold value $I_T$ which is detected by detecting circuit 14. In other words, the detecting circuit 14 detects an over current in the controlled path of switching circuit 12 and produces an output signal which is latched in the latch 15. The latched over current output signal is provided to the gate driver 13 which operates the switching circuit 12 to switch to the non-conducting state. As a consequence, the load current of the bulb 3 decreases as shown in FIG. 5. At the same time, the latched over current output signal of the detecting circuit 14 is also provided to the recovery timer 16 which starts to count. The recovery timer 16 produces a respective output signal after a particular time period from starting counting has elapsed. This output signal from the recovery timer is supplied to the reset input of the latch 15 which, when reset, causes the gate driver 13 to switch the switching circuit 12 again in conducting state. As a result, the load current of the bulb 3 again increases until it reaches the threshold value $I_T$ detected by the detecting circuit 14. This process as described above is repeated until the load current keeps below the threshold value $I_T$ and develops towards the stationary load current as shown in FIG. 5.

The pulse width modulated load current of the principle as shown in FIG. 5 provides sufficient average current to power up the load (in the present example, to heat up the bulb) until the load reaches stationary operating condition. Advantages with respect to limiting the inrush current as shown in FIG. 3 result from the fact that the power for heating up the bulb is determined from $$P=I^2R_{load}$$

with P being the power, I being the load current through the bulb and $R_{load}$ being the resistance of the bulb. Consequently, advantages as compared to the approach according to FIG. 3 are lower power dissipation on the integrated circuit (lower power dissipation on silicon), lower thermal stress, lower chip size and, thus, cost reduction in manufacturing costs, and a higher lifetime of the bulb.

When having a driving circuit 10 as shown with reference to FIG. 4 for driving a load 3, in some applications it may be necessary to drive loads (particularly bulbs) with higher power, but using the driving circuit 10 of the principle as shown in FIG. 4 which is designed for driving loads with lower power. In other words, it is not desirable to provide different driving circuits 10, with keeping one driving circuit design for driving loads with lower power and another driving circuit design for driving loads with higher power.

A solution for driving loads with higher power, but using a driving circuit design which is capable of driving loads with lower power, is to use two switching circuits connected in parallel to a load with higher power. For example, when using a driving circuit design as shown in FIG. 4, another driving circuit 10 may be coupled to a bulb 3 with higher power having a second switching circuit which is coupled to the bulb 3 in parallel to the switching circuit 12 as shown in FIG. 4. As a consequence of using two switching circuits in parallel, higher load currents may be switched in order to drive loads with higher power. However, a problem may arise in the event that the two switching circuits are operated to switch to a conducting state at different times, such as shown in FIG. 6. In FIG. 6, a signal diagram is shown depicting an example of a limited inrush current of the principle as shown in FIG. 5 when driving a bulb of higher power and using two driving circuits of the principle as shown in FIG. 4 connected to the bulb in parallel. As shown in FIG. 6, the switching circuit of one of the driving circuits ("Switch 1") is switched to a conducting state at a time which is different from the time of when the switching circuit of the other driving circuit ("Switch 2") is switched to the conducting state. As a result of the different switching times, it is not possible to get the needed higher load current for driving the load with higher power since the two pulse width modulated currents of the two driving circuits will not provide sufficient average current to power up the load (e.g. heat up the bulb according to $P=I^2R_{load}$). Consequently, this approach would not work properly when driving bulbs for the reasons as set out above.

Therefore, it would be beneficial to provide a driving circuit which is capable of driving loads, such as bulbs, with higher power.

BRIEF SUMMARY

In a first aspect, the present disclosure provides a driving circuit comprising at least a first and a second switching circuit coupled in parallel to a node which is adapted to be coupled to a load, at least a first and a second detecting circuit, the first detecting circuit detecting a current associated with the first switching circuit and the second detecting circuit detecting a current associated with the second switching circuit, and a synchronizing circuit having an input coupled to the first and second detecting circuits and having an output coupled to the first and second switching circuits. The synchronizing circuit operates the first and second switching circuits to switch synchronously to a conducting state, and operates the first and second switching circuits to switch synchronously to a non-conducting state in the event that one of the first and second detecting circuits detects a current equal to or higher than a threshold value.

In accordance with another aspect of the present disclosure, a driving circuit is provided which comprises at least a first and a second switching circuit, the first switching circuit having a first control input and a first controlled path, and the second switching circuit having a second control input and a second controlled path, with the first and second controlled paths coupled in parallel to a node which is adapted to be coupled to a load. The driving circuit further comprises at least a first and a second detecting circuit, the first detecting circuit coupled to the first controlled path for detecting current in the first controlled path, and the second detecting circuit coupled to the second controlled path for detecting current in the second controlled path. The driving circuit further comprises a synchronizing circuit having an input coupled to the first and second detecting circuits and having an output coupled to the first and second control inputs of the first and second switching circuits. The synchronizing circuit provides first output signals to the first and second control inputs for synchronously switching the first and second controlled paths in a conducting state, and provides second output signals to the first and second control inputs for synchronously switching the first and second controlled paths and a non-conducting state in the event that one of the first and second detecting circuits detects a current equal or higher than a threshold value.

In accordance with another aspect of the present disclosure, a method for driving a load is provided that comprises providing at least a first and a second switching circuit coupled in parallel to a node which is coupled to a load, detecting a current associated with the first switching circuit and detecting a current associated with the second switching circuit when the first and second switching circuits are in a respective conducting state for driving the load, operating the first and second switching circuits to switch synchronously to a non-conducting state in the event that a detected current associated with one of the first and second switching circuits is equal to or higher than a threshold value, and operating the first and second switching circuits to switch synchronously to the conducting state when the first and second switching circuits are in a respective non-conducting state.

According to another aspect of the present disclosure, there is provided a method for driving a load, comprising providing at least a first and a second switching circuit coupled in parallel to a node which is coupled to a load, detecting a current associated with the first switching circuit, and detecting a current associated with the second switching circuit when the first and second switching circuits are in a respective conducting state for driving the load, operating the first and second switching circuits to switch synchronously to a non-conducting state and starting counting a time in the event that a detected current associated with one of the first and second switching circuits is equal to or higher than a threshold value, and operating the first and second switching circuits to switch synchronously to the conducting state after a time period from starting counting the time has elapsed.

Accordingly, a driving circuit and method for driving a load may be provided which is capable of driving loads with higher power, particularly bulbs having rather high inrush currents resulting from heating up the bulb. As a result of synchronously switching the switching circuits to a conducting and non-conducting state, respectively, the load currents in both switching circuits can be added for driving loads with higher power. Due to the quadratic impact of current ($P=I^2R_{load}$) it is possible to drive bulbs with higher power for heating up the bulb.

In accordance with another aspect of the present disclosure, in the foregoing driving circuit, the synchronizing circuit comprises a control input which receives a control signal for operating the synchronizing circuit in a first mode or in a second mode. The synchronizing circuit operates the first and second switching circuits to switch synchronously to the conducting state and to the non-conducting state in the first mode, and operates at least one of the first and second switching circuits to switch independently to the conducting state and to the non-conducting state in the second mode. In accordance with this aspect, a driving circuit may be provided which is flexible in use since in the first mode, a load with higher power may be operated with the first and second switching circuits operated in parallel and synchronously as set out above, whereas in the second mode one or two loads with lower power may be operated independently using a respective one of the switching circuits.

BRIEF DESCRIPTION OF THE SEVERAL VIEWS OF THE DRAWINGS

The foregoing aspects and other features and advantages of the present disclosure will now be described with reference to the drawings, in which.

DETAILED DESCRIPTION

Figure 7:
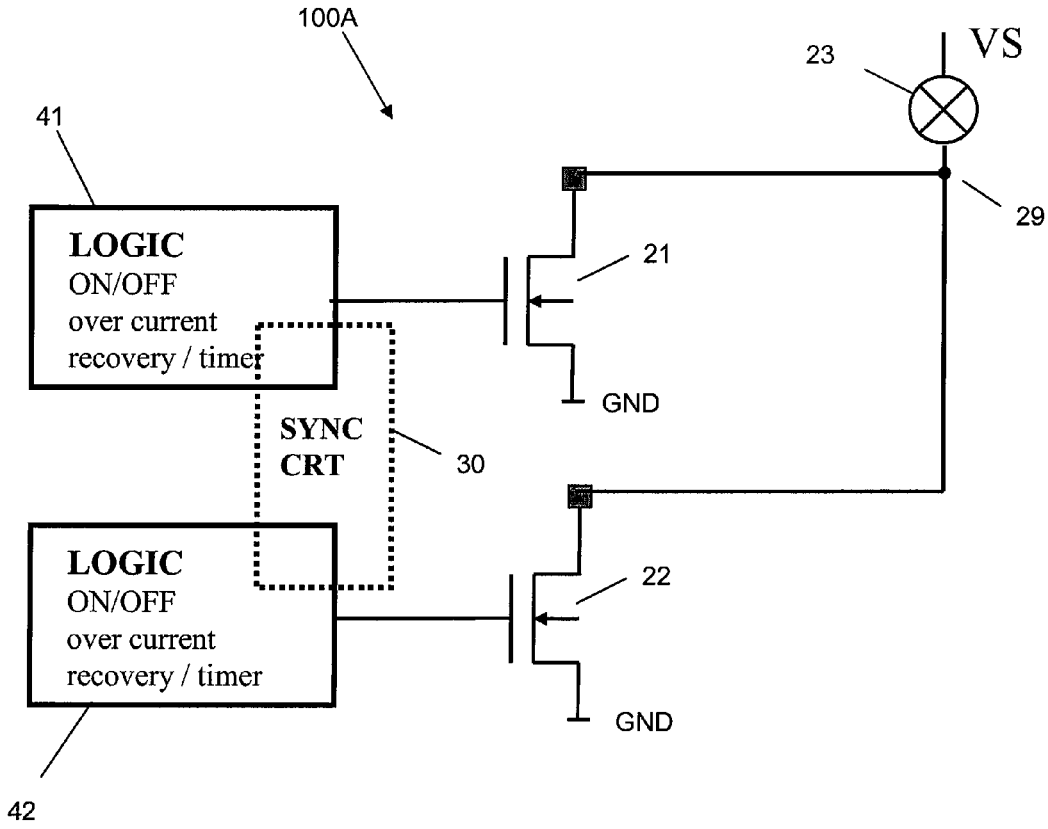
FIG. 7 shows a driving circuit according to an embodiment of the present disclosure.

FIG. 7 shows a driving circuit according to an embodiment of the present disclosure. Generally, a driving circuit in accordance with the present disclosure may be used for driving any kind of loads, particularly may be used for driving loads with high inrush current. More particularly, a driving circuit in accordance with the present disclosure may be used for driving bulbs or incandescent lamps where such inrush currents usually occur as a matter of heating up the bulb to stationary conditions. In general, the following disclosure shall not be construed to limit the disclosure to the specific embodiments as disclosed therein.

The driving circuit 100A according to the embodiment of FIG. 7 comprises a first switching circuit 21 and a second switching circuit 22, which may be, in principle, any kind of switching circuits having a conducting state and a non-conducting state. For example, the switching circuits 21 and 22 may each comprise one or more switching elements such as transistors as is commonly known to the person skilled in the art and shown, in one example, in FIG. 7. A first node of each respective switching circuit 21, 22 is coupled to a common node 29 which is coupled to a load 23, which is in the present example a bulb. The other terminal of the bulb 23 is coupled to a supply voltage VS. Thus, the switching circuits 21 and 22 are connected in parallel to the node 29. Particularly, each of the switching circuits 21 and 22 comprise a respective controlled path which is connected between node 29 and a reference potential GND such as ground. The switching circuits 21 and 22 each comprise a respective control input for controlling the respective controlled path to switch to the conducting or non-conducting state. The control input of the first switching circuit 21 is coupled to a control logic circuit 41, and the control input of the second switching circuit 22 is coupled to a second control logic circuit 42, the function thereof will be explained in more detail below. The driving circuit 100A further comprises a synchronizing circuit 30 (only schematically shown in FIG. 7) which is adapted to cause the control circuits 41, 42 to synchronously operate the switching circuits 21 and 22 as set out in more detail below.

Figure 8:
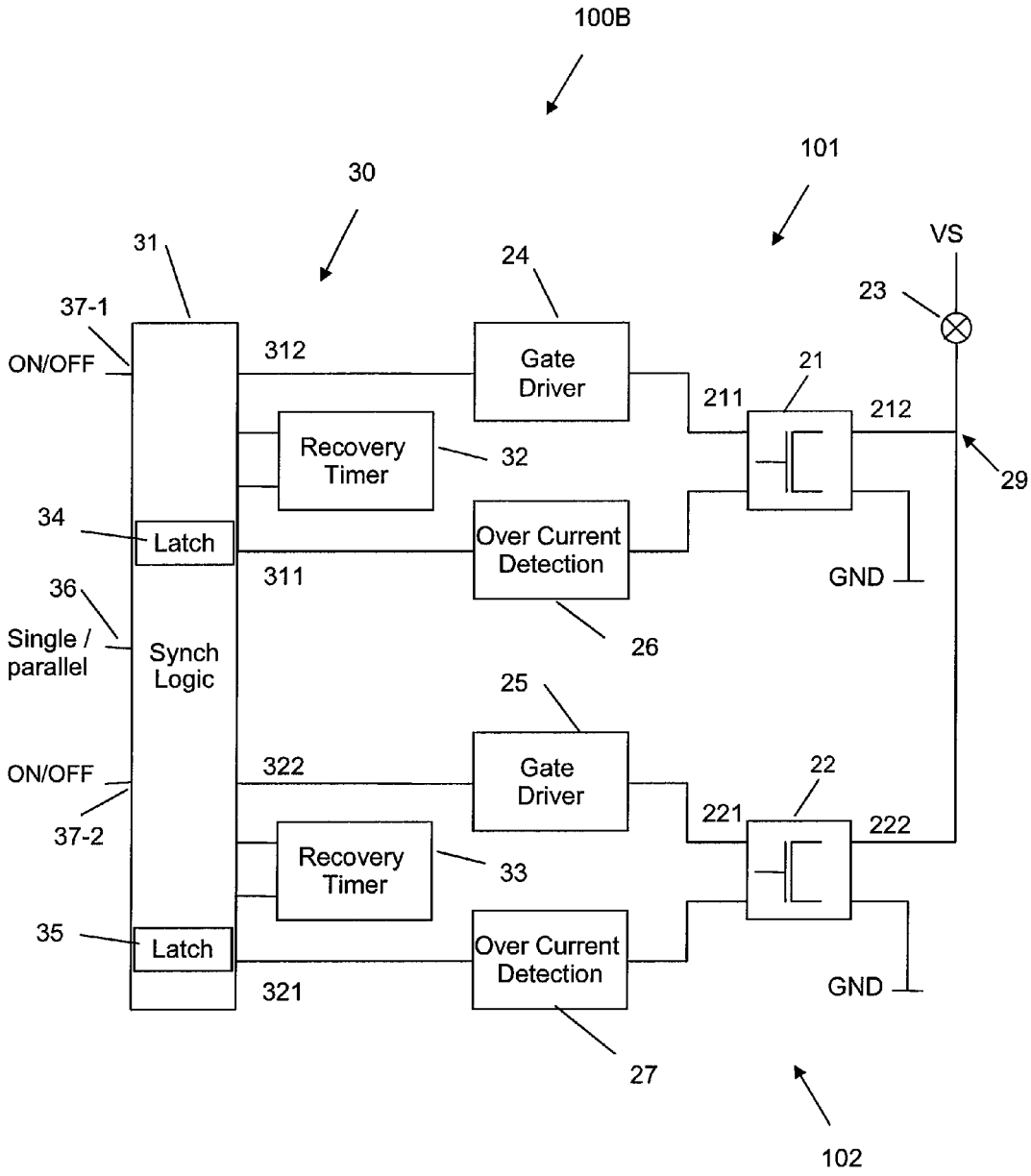
FIG. 8 shows a driving circuit according to another embodiment of the present disclosure.

FIG. 8 shows a driving circuit according to another embodiment of the present disclosure. Particularly, the driving circuit 100B as shown in FIG. 8 comprises first and second switching circuits 21, 22 which are coupled in parallel to the node 29 as described above with reference to FIG. 7. More particularly, the first switching circuit 21 comprises a first control input 211 and a first controlled path 212 which is coupled to the node 29. The second switching circuit 22 comprises a second control input 221 and a second controlled path 222 which is also coupled to the node 29. Thus, the controlled paths 212, 222 are coupled in parallel to the load 23. The respective other nodes of the controlled paths 212, 222 are coupled to reference potential GND. For example, the controlled paths 212, 222 may be drain-source-paths or collector-emitter-paths of respective switching transistors.

In the example of FIG. 8, the first control input 211 is coupled to a gate driver 24 which is particularly designed for driving a gate of a switching transistor included in the switching circuit 21. However, in other embodiments a separate gate driver 24 may not be necessary, or an appropriate circuit may be included in the switching circuit 21. Further, in the switching circuits 21, 22, in principle, any kind of switching elements may be used which are appropriate for driving loads such as a bulb. The skilled person will appreciate that appropriate circuits may be included for driving any such switching elements for achieving proper functioning depending on the particular type of switching element. Similarly as explained with reference to switching circuit 21, the control input 221 of the second switching circuit 22 is coupled, in the present embodiment, to gate driver 25 for driving a gate of a switching transistor included in the switching circuit 22. However, as described above, there may be embodiments in which gate driver 25 is dispensed with.

The driving circuit 100B further comprises a first detecting circuit 26 for detecting a current associated with the first switching circuit 21, and a second detecting circuit 27 for detecting a current associated with the second switching circuit 22. More particularly, the detecting circuit 26 is coupled to the controlled path 212 of the switching circuit 21 for detecting current in the controlled path 212, whereas the detecting circuit 27 is coupled to the controlled path 222 of the switching circuit 22 for detecting current in the controlled path 222. Specifically, each of the detecting circuits 26, 27 are designed to detect a current in the respective controlled path which is equal to or higher than a current threshold value.

Further, the driving circuit 100B comprises a synchronizing circuit 30 having input nodes 311, 321 forming an input of the synchronizing circuit 30, and having output nodes 312, 322 forming an output of the synchronizing circuit 30. More particularly, the input node 311 is coupled to an output of the detecting circuit 26, and the input node 321 is coupled to an output of the detecting circuit 27. The output node 312 is coupled to the control input 211 of the switching circuit 21 through gate driver 24 or directly in case where such gate driver is not necessary or part of the switching circuit 21.

Analogously, the output node 322 of the synchronizing circuit 30 is coupled to the control input 221 of the switching circuit 22 either through gate driver 25 or directly. In the present example, the synchronizing circuit 30 comprises a synchronizing logic circuit 31 schematically shown as a block in FIG. 8, and also comprises a timing circuit which encompasses a first timer 32 and a second timer 33, each denoted as respective "recovery timer", the function thereof will be described in more detail below.

In this way, the driving circuit 100B comprises a first driving circuit 101 including switching circuit 21 and the control circuit thereof as described above, and comprises a second driving circuit 102 including switching circuit 22 and its control circuit as described above. The driving circuits 101, 102 may be enabled or disabled by respective "ON/OFF" signals provided at respective inputs 37-1 and 37-2 of the synchronizing logic circuit 31. The synchronizing circuit 30 operates the first and second driving circuits 101, 102 and their respective first and second switching circuits 21, 22 to switch synchronously to a conducting state and a non-conducting state for driving the load 23 as follows:

For the following considerations it is assumed that both driving circuits 101 and 102 are enabled by receiving a respective "ON" signal at the respective input 37-1 and 37-2 of the synchronizing logic circuit 31. Further, it is assumed that the gate drivers 24 and 25 are providing an output signal to the control inputs 211 and 221 for operating the respective switching circuit 21 and 22 in a conducting state, so that the controlled paths 212 and 222 are conductive, i.e. in a low ohmic state. At a control input 36 of the synchronizing circuit a control signal is received which causes the synchronizing circuit 30 to operate in a first mode, which is in the present case an operating mode in which the driving circuits 101 and 102 are operated in parallel or synchronously ("parallel mode").

Figure 1:
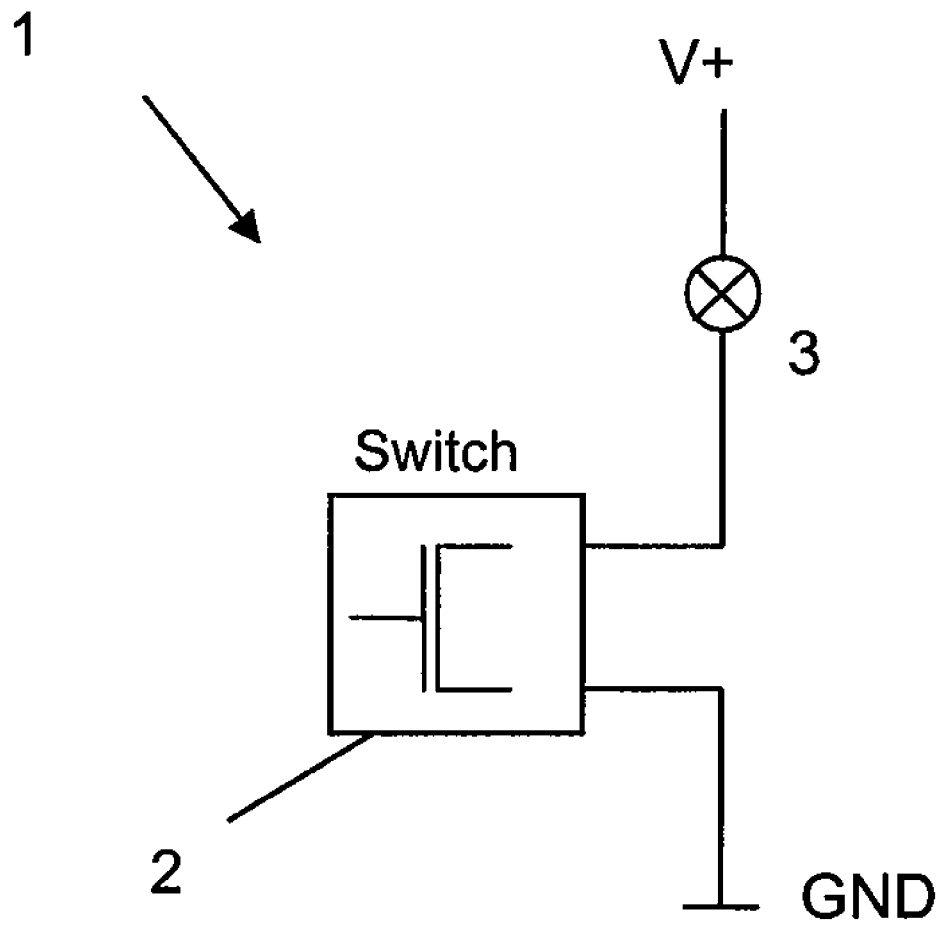
Fig. 1 Prior Art
FIG. 1 shows a driving circuit according to a prior approach that has been used.
Figure 2:
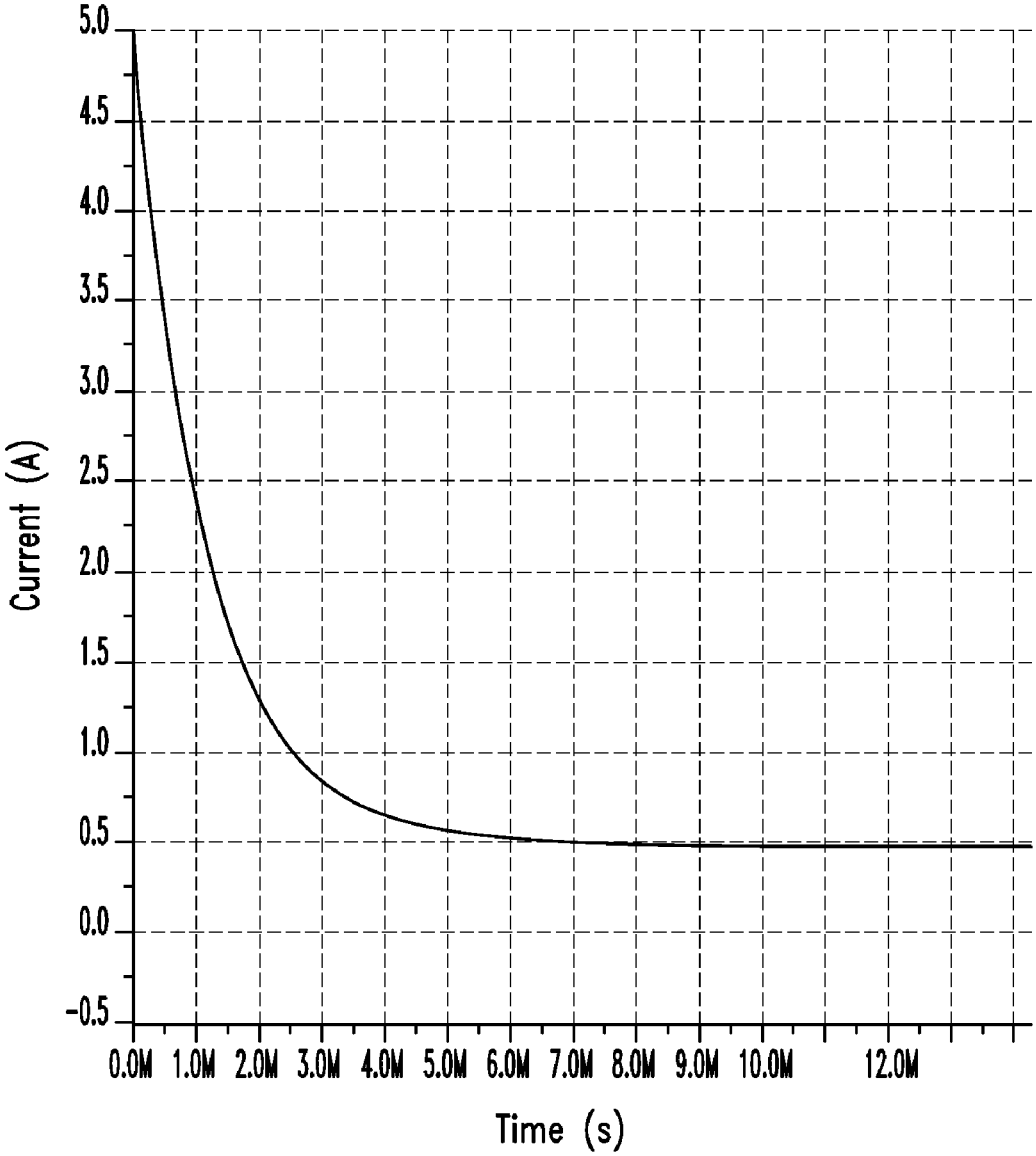
FIG. 2 (Prior Art)
FIG. 2 shows a signal diagram depicting an example of an inrush current of a driving circuit of the principle as shown in FIG. 1 when driving a bulb.
Figure 3:
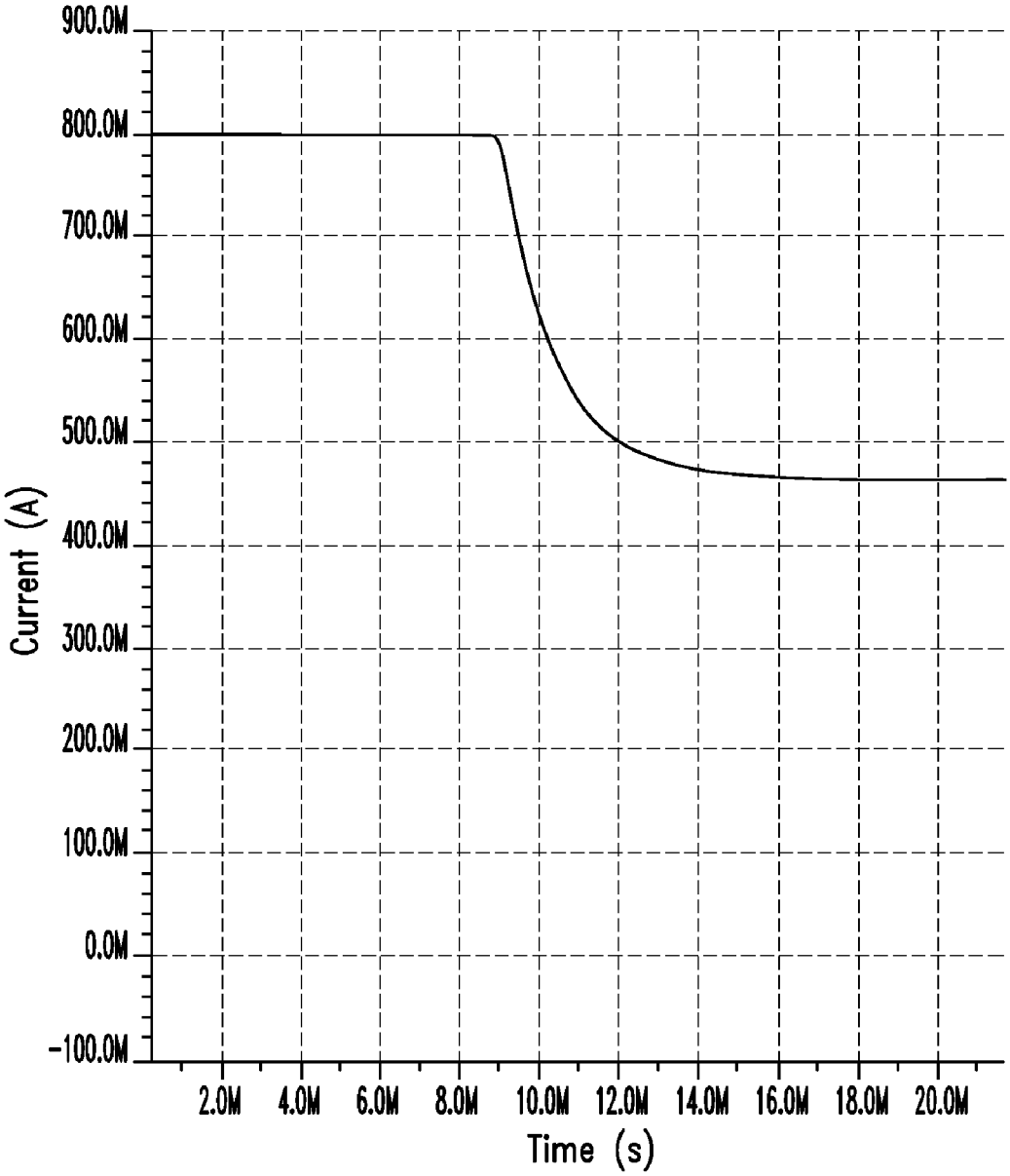
FIG. 3 (Prior Art)
FIG. 3 shows a signal diagram depicting another example of an inrush current of a driving circuit of the principle as shown in FIG. 1 with limitation of the inrush current at a fixed value according to another prior approach.
Figure 4:
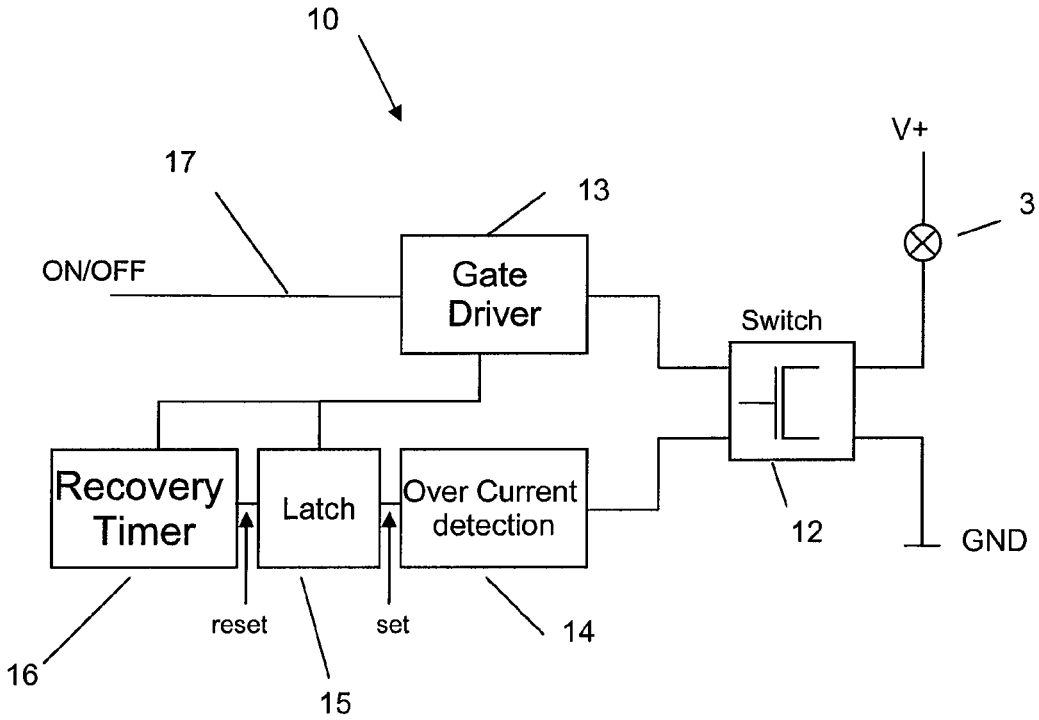
Fig. 4 Prior Art
FIG. 4 shows an exemplary driving circuit according to another prior approach using a pulse width modulated control circuit for driving the load.
Figure 5:
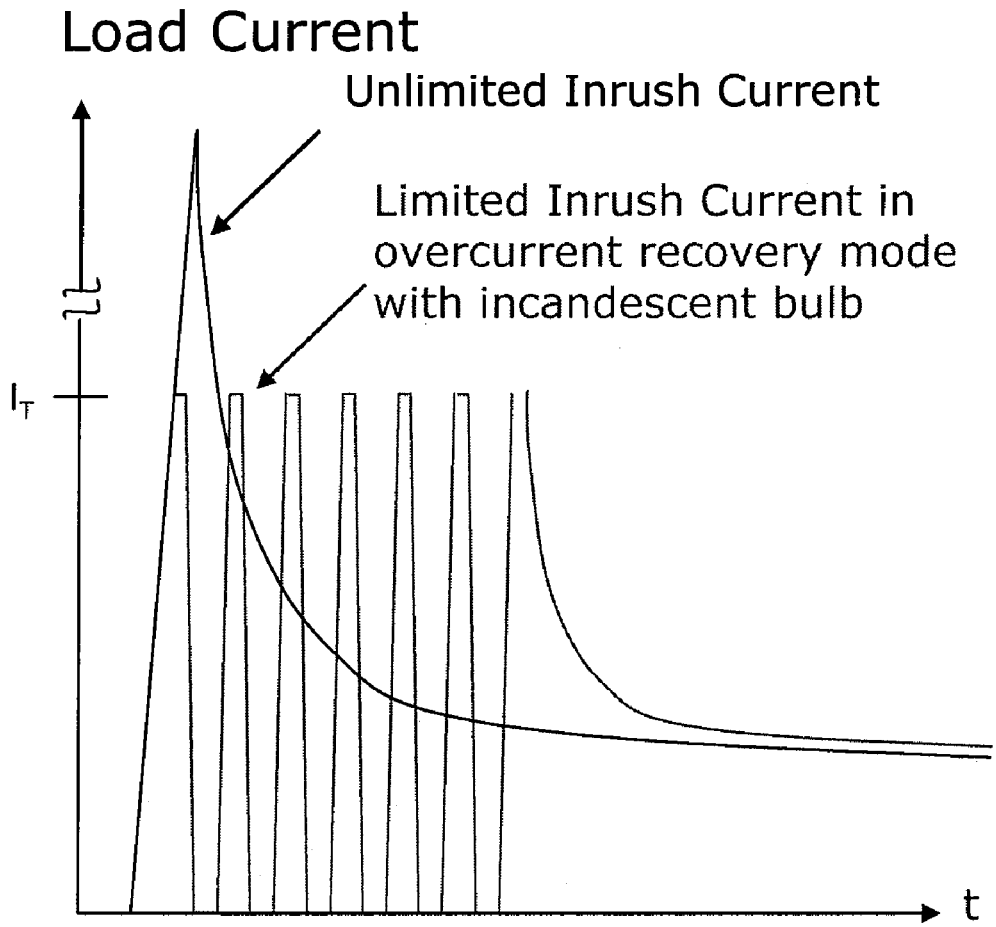
Fig. 5 Prior Art
FIG. 5 shows a signal diagram depicting an example of a limited inrush current of a driving circuit of the principle as shown in FIG. 4 when driving a bulb.
Figure 6:
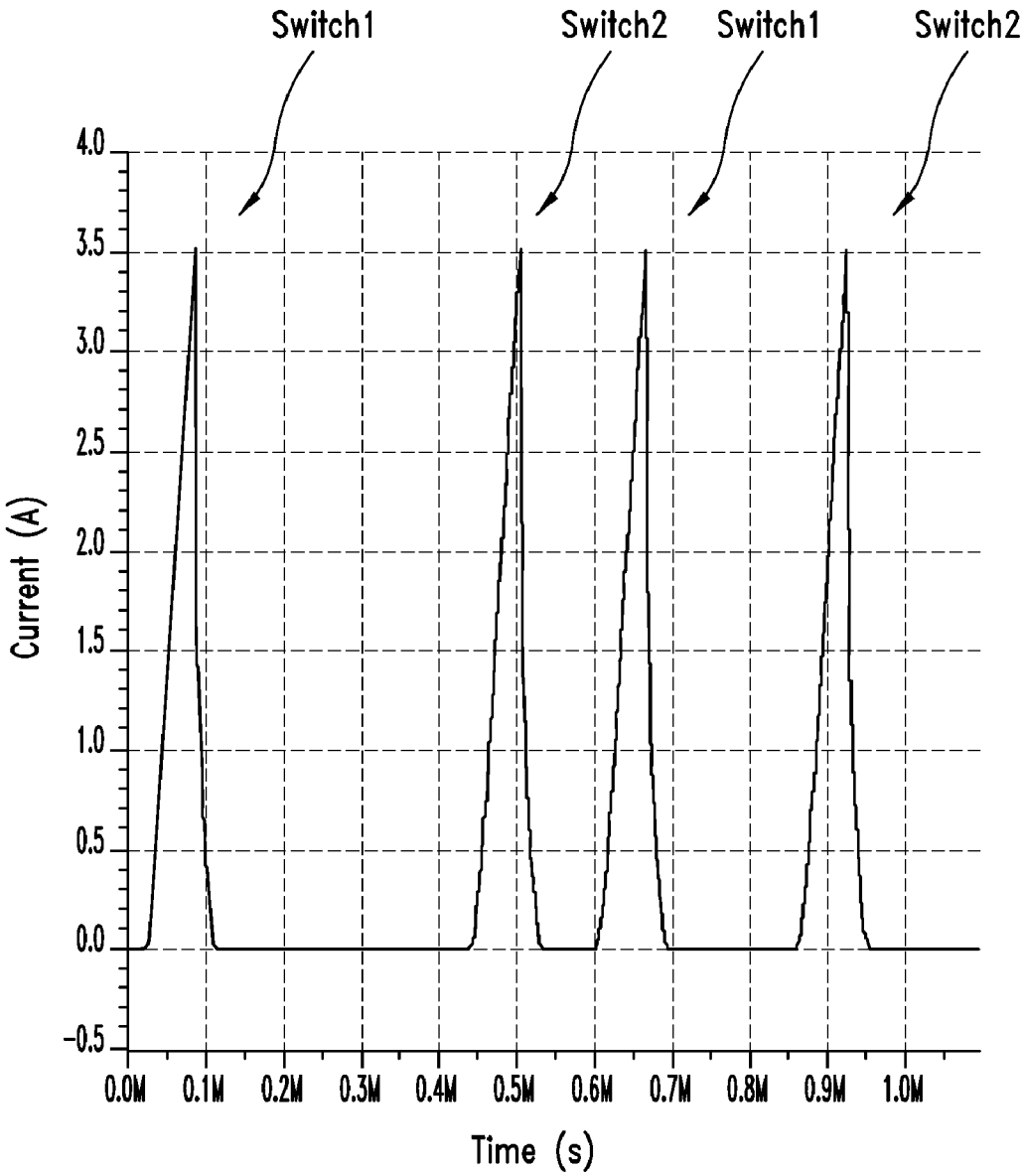
FIG. 6 (Prior Art)
FIG. 6 shows a signal diagram depicting an example of a limited inrush current when driving a bulb with higher power and using two driving circuits of the principle as shown in FIG. 4 coupled in parallel.

When both switching circuits 21 and 22 are in conductive state, the load current through the load 23 is increasing according to the principles such as shown in FIG. 5 in case that the load 23 is a bulb. In the event that at least one of the detecting circuits 26 and 27 detects a current in the controlled paths 212, 222 which is equal to or higher than a threshold value (such as $I_T$ as shown in FIG. 5), the respective detecting circuit 26 or 27 produces a corresponding over current output signal at its output which is provided to input node 311 or input node 321 depending on whether detecting circuit 26 or detecting circuit 27 is detecting the over current event. For latching the over current signal provided from any one of detecting circuits 26 or 27, the synchronizing circuit 30 further comprises latching circuits 34, 35 which respectively latch output signals of the detecting circuits 26, 27. More particularly, a first latch 34 latches the output signal of the detecting circuit 26, and a second latch 35 latches the output signal of the detecting circuit 27. For example, in an over current event, the output signal of the detecting circuit 26 or detecting circuit 27 will make a transition from logic state "0" to logic state "1" indicating that an over current event has occurred. As a consequence, the synchronizing circuit 30 provides output signals at output nodes 312, 322 for switching the switching circuits 21 and 22 synchronously to a non-conducting state. For example, respective output signals may be generated which cause the gate drivers 24 and 25 to transition from logic state "1" to logic state "0" synchronously, which causes switching circuits 21 and 22 to switch off (non-conductive state or high ohmic state) synchronously. As a result, the switching circuits 21 and 22 transition to the non-conducting state synchronously, particularly substantially simultaneously. Further, when detecting the over current event, i.e., in the event that one of the detecting circuits 26, 27 detects a current equal to or higher than the threshold value, the timing circuit is coupled to start counting. More particularly, each of the recovery timers 32 and 33 are caused to start counting a time until a particular time period has elapsed. According to another embodiment, each of the recovery timers 32 and 33 start counting a time wherein the synchronizing circuit 30 comprises a logic circuit which detects when a particular time period has elapsed. In either case, a corresponding output signal of the timing circuit will be provided after a particular time period from starting counting has elapsed. For example, such an output signal may be produced by one of the recovery timers 32, 33, however, the skilled person will appreciate that also other embodiments for producing such output signal may be employed.

In the event that such output signal of the timing circuit has been produced (for example, the recovery time period of one of the recovery timers 32 and 33 from starting counting the time has expired) the respective latch 34 or 35, which had been set previously when detecting an over current event, will be reset, for example from logic state "1" to logic state "0". As a result, respective output signals at output nodes 312, 322 are produced which cause the switching circuits 21 and 22 to synchronously switch to the conducting state, so that load current is caused to flow substantially simultaneously through the controlled paths 212, 222 of the switching circuits 21 and 22. More particularly, the output signals at output nodes 312, 322 may cause the gate drivers 24 and 25 to transition from logic state "0" to logic state "1" at their outputs which cause the switching circuits 21 and 22 to switch to the conductive state synchronously. In this way, a load current of the principle such as shown in FIG. 5 may be generated for each of the driving circuits 101 and 102, wherein as a result of the synchronous switching of the switching circuits 21 and 22 to the conducting state and the non-conducting state, respectively, both load currents of driving circuits 101 and 102 can be added at the load 23, so that the effective load current at the load 23 is doubled. In case of driving a bulb as load 23, due to the quadratic impact of the load current when heating up the bulb (heating up power determined according to $P=I^2R_{load}$) it is possible to drive bulbs with higher power with the same circuit design of driving circuits 101 and 102.

On the other hand, when the control input 36 of the synchronizing circuit 30 receives a control signal for operating the synchronizing circuit in the second mode, each of the driving circuits 101 and 102 may be operated independently from one another. Particularly, only one of the driving circuits 101 and 102 may be used for driving a load 23 with lower power, so that the respective other of the driving circuits 101, 102 may be deactivated. For example, for driving a load 23 having lower power driving circuit 101 will be used, so that signal line 37-1 receives a corresponding "ON" signal and signal line 37-2 receives an "OFF" signal, and control input 36 receives a control signal which is indicative of a "single mode" which causes the synchronizing circuit 30 to operate only one of the driving circuits 101, 102 in an independent manner, or both driving circuits 101, 102 independently from one another, for example, when driving two loads of lower power independently from one another.

In this way, the driving circuit as described above with reference to FIGS. 7 and 8 is designed to be very flexible in driving loads of different power, depending on the particular application. The circuit design as shown in FIG. 8 employing two switching circuits coupled in parallel to a load may be varied to any circuit design using, in principle, any number of switching circuits coupled in parallel to a load depending on the particular needs and application. Moreover, the driving circuits of FIGS. 7 and 8 have been described to operate in a so-called low side configuration with the load coupled to a supply voltage and the switching circuits coupled to a reference potential (e.g., to ground). However, according to another embodiment, the driving circuit may also be operated in a high side configuration with the load coupled to a reference potential and the switching circuits coupled to a supply voltage.

While this detailed description has set forth some embodiments of the present disclosure, the appended claims cover also other embodiments of the present disclosure which may differ from the described embodiments according to various modifications and some aspects. For example, from the above description of the function of the synchronizing circuit the skilled person will appreciate that also other implementations of a particular synchronizing circuit may be used for driving the respective switching circuits as described above. Furthermore, while the components of the driving circuit are shown as respective function blocks in a schematic block diagram, the skilled person knows from his skill in the art how to implement each of the blocks according to their respective function as described above. Further, it is to be understood that the above description is intended to be illustrative and not restrictive. Moreover, in this disclosure terms such as "first", "second" and "third", etc., are used merely as labels, and are not intended to impose numerical requirements on their objects. Other embodiments and modifications within the scope of the claims will be apparent to those of skill in the art upon studying the above description in connection with the drawings.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A driving circuit, comprising:

a first and a second switching circuit coupled in parallel to a node configured to be coupled to a load, a first and a second detecting circuit, the first detecting circuit being configured to detect a current associated with the first switching circuit, the second detecting circuit being configured to detect a current associated with the second switching circuit, and a synchronizing circuit having an input coupled to the first and second detecting circuits and having an output coupled to the first and second switching circuits, wherein the synchronizing circuit is configured to operate the first and second switching circuits to switch synchronously to a conducting state, and is configured to operate the first and second switching circuits to switch synchronously to a non-conducting state in the event that one of the first and second detecting circuits detects a current equal to or higher than a threshold value.

2. The driving circuit of claim 1, wherein:

the first switching circuit comprising a first control input and a first controlled path and the second switching circuit comprising a second control input and a second controlled path, with the first and second controlled paths being coupled in parallel to the node, the first detecting circuit is coupled to the first controlled path for detecting current in the first controlled path, and the second detecting circuit is coupled to the second controlled path for detecting current in the second controlled path, the output of the synchronizing circuit is coupled to the first and second control inputs of the first and a second switching circuits, and the synchronizing circuit is configured to provide first output signals to the first and second control inputs for synchronously switching the first and second controlled paths in a conducting state, and is configured to provide second output signals to the first and second control inputs for synchronously switching the first and second controlled paths in a non-conducting state in the event that one of the first and second detecting circuits detects a current equal to or higher than the threshold value.

3. The driving circuit of claim 1, wherein the first and second switching circuits are configured to drive at least one bulb as the load.

4. The driving circuit of claim 1, wherein:

the synchronizing circuit comprises a control input configured to receive a control signal for operating the synchronizing circuit in a first mode or in a second mode, and the synchronizing circuit is configured to operate the first and second switching circuits to switch synchronously to the conducting state and to the non-conducting state in the first mode, and operates at least one of the first and second switching circuits to switch independently to the conducting state and to the non-conducting state in the second mode.

5. The driving circuit of claim 1, wherein the synchronizing circuit comprises a timing circuit, with the synchronizing circuit being configured to operate the first and second switching circuits to switch synchronously to the conducting state in response to an output signal of the timing circuit.

6. The driving circuit of claim 5, wherein the timing circuit is coupled to start counting in the event that one of the first and second detecting circuits detects a current equal to or higher than the threshold value and provides the output signal after a time period from starting counting has elapsed.

7. The driving circuit of claim 1, wherein the synchronizing circuit further comprises a latching circuit configured to latch a respective output signal of the first and second detecting circuits.

8. A driving circuit, comprising:

a first and a second switching circuit, the first switching circuit having a first control input and a first controlled path and the second switching circuit having a second control input and a second controlled path, with the first and second controlled paths being coupled in parallel to a node configured to be coupled to a load, a first and a second detecting circuit, the first detecting circuit being coupled to the first controlled path for detecting current in the first controlled path, the second detecting circuit being coupled to the second controlled path for detecting current in the second controlled path, and a synchronizing circuit having an input coupled to the first and second detecting circuits and having an output coupled to the first and second control inputs of the first and second switching circuits, wherein the synchronizing circuit is configured to provide first output signals to the first and second control inputs for synchronously switching the first and second controlled paths in a conducting state, and is configured to provide second output signals to the first and second control inputs for synchronously switching the first and second controlled paths in a non-conducting state in the event that one of the first and second detecting circuits detects a current equal to or higher than a threshold value.

9. The driving circuit of claim 8, wherein the first and second switching circuits are configured to drive at least one bulb as the load.

10. The driving circuit of claim 8, wherein:

the synchronizing circuit comprises a control input configured to receive a control signal for operating the synchronizing circuit in a first mode or in a second mode, the synchronizing circuit is configured to operate the first and second switching circuits to switch synchronously to the conducting state and to the non-conducting state in the first mode, and is configured to operate one of the first and second switching circuits to switch independently to the conducting state and to the non-conducting state in the second mode.

11. The driving circuit of claim 8, further comprising a timing circuit coupled to the synchronizing circuit, with the synchronizing circuit being configured to operate the first and second switching circuits to switch synchronously to the conducting state in response to an output signal of the timing circuit.

12. The driving circuit of claim 11, wherein the timing circuit is coupled to start counting in the event that one of the first and second detecting circuits detects a current equal to or higher than the threshold value and provides the output signal to the synchronizing circuit after a time period from starting counting has elapsed.

13. A method for driving a load, comprising:

detecting a current, associated with a first switching circuit coupled in parallel with a second switching circuit to a node which is coupled to a load, when the first switching circuit is in a conducting state for driving the load;

detecting a current associated with the second switching circuit when the second switching circuits is in a conducting state for driving the load;

operating the first and second switching circuits to switch synchronously to a non-conducting state in the event that one of the detected currents is equal to or higher than a threshold value; and operating the first and second switching circuits to switch synchronously to the conducting state when the first and second switching circuits are in the non-conducting state.

14. The method of claim 13, wherein the load includes a bulb.

15. The method of claim 13, further comprising operating the first and second switching circuits to switch synchronously to the conducting state and to the non-conducting state in a first mode, and operating at least one of the first and second switching circuits to switch independently to the conducting state and to the non-conducting state in a second mode, the first and second modes being controllable by a control signal.

16. The method of claim 13, further comprising starting counting a time in the event that one of the detected currents is equal to or higher than the threshold value, and switching the first and second switching circuits synchronously to the conducting state after a time period from starting counting the time has elapsed.

17. A method for driving a load, comprising:

detecting a current, associated with a first switching circuit coupled in parallel with a second switching circuit to a node which is coupled to a load, when the first switching circuit is in a conducting state for driving the load;

detecting a current associated with the second switching circuit when the second switching circuits is in a conducting state for driving the load;

operating the first and second switching circuits to switch synchronously to a non-conducting state;

starting counting a time in the event that one of the detected currents is equal to or higher than a threshold value; and operating the first and second switching circuits to switch synchronously to the conducting state after a time period from starting counting the time has elapsed.

18. The method of claim 17, receiving at a control input of the synchronizing circuit a control signal for operating the synchronizing circuit in a first mode or in a second mode;

operating the first and second switching circuits to switch synchronously to the conducting state and to the non-conducting state in the first mode; and operating one of the first and second switching circuits to switch independently to the conducting state and to the non-conducting state in the second mode.

19. A circuit, comprising:

a load; and a driving circuit configured to drive the load, the driving circuit including:

a first and a second switching circuit coupled in parallel to a node coupled to the load, a first and a second detecting circuit, the first detecting circuit being configured to detect a current associated with the first switching circuit, the second detecting circuit being configured to detect a current associated with the second switching circuit, and a synchronizing circuit having an input coupled to the first and second detecting circuits and having an output coupled to the first and second switching circuits, wherein the synchronizing circuit is configured to operate the first and second switching circuits to switch synchronously to a conducting state, and is configured to operate the first and second switching circuits to switch synchronously to a non-conducting state in the event that one of the first and second detecting circuits detects a current equal to or higher than a threshold value.

20. The circuit of claim 19, wherein the load includes a bulb.

* * * * *